United States Patent [19]

Endo et al.

[11] 3,930,322

[45] Jan. 6, 1976

[54] CLOG

[76] Inventors: Ichitaro Endo, 1-62 Taikodori, Nakamura-ku; Kenichi Tamano, 2-11 Takeda-cho, Mizuho-ku; Tadashi Sato, 1-62 Taikodori, Nakamura-ku, all of Nagoya, Aichi, Japan

[22] Filed: Apr. 14, 1975

[21] Appl. No.: 568,146

[52] U.S. Cl. ..... 36/11.5

[51] Int. Cl.[2] ..... A43B 3/12

[58] Field of Search ..... 36/2.5 R, 11.5

[56] References Cited

UNITED STATES PATENTS

| | | | |
|---|---|---|---|
| 2,395,767 | 2/1946 | Sutcliffe | 36/11.5 |
| 2,932,097 | 4/1960 | George | 36/11.5 |
| 3,290,802 | 12/1966 | Fukuoka | 36/11.5 |
| 3,336,683 | 8/1967 | Schellkopf | 36/11.5 |

*Primary Examiner*—Patrick D. Lawson
*Attorney, Agent, or Firm*—Hammond & Littell

[57] ABSTRACT

A clog which comprises a body provided adjacent to one end with a first pair of through holes extending in parallel to each other and to the longitudinal axis of said body on the opposite sides of said axis in close proximity to the latter and adjacent to the other end with a second pair of through holes in proximity to the opposite side edges of said body at an angle with respect to said longitudinal axis; and a pair of identical pliable synthetic resin thongs of an ecliptical configuration in cross-section each having one end extending through one of said first pair of holes and the other end extending through one of said second pair of holes, the extensions at the opposite ends of said pair of thongs fused together to form lumps on the under surface of said clog body to prevent the thongs from separating from the clog body.

1 Claim, 5 Drawing Figures

CLOG

BACKGROUND OF THE INVENTION

This invention relates to a clog and more particularly, to a pliable synthetic resin thong for use with the clog.

There have been proposed and practically employed a great variety of clogs and one of the most common type clogs comprises wooden body having a round hole positioned at a point in the longitudinal axis of the body adjacent to one end and a pair of round holes positioned on the opposite sides of the longitudinal axis adjacent to the other end and to the opposite side edges of the body and a single thong which comprises a hemp core or or the like of a length, a stuffing surrounding the core except at the opposite ends of the core which extend beyond the adjacent ends of the stuffing and a fabric in the form of a narrow strip covering a substantial portion of the core and substantially the entire stuffing leaving the opposite ends of the core uncovered and sewn together at the opposite side edges of the fabric. The thong is conventionally secured to the clog body by folding in the center thereof where the stuffing has been removed or substantially removed into two thong portions, applying a fore strap about the center of the thong, passing the opposite ends of the fore strap through the axially positioned hole adjacent to one end of the clog body, tying the opposite ends of the fore strap together on the under surface of the clog body to make a knot having a size larger than the size of the associated hole to prevent the fore strap from coming off the hole, passing the free ends of the two thong portions through the holes adjacent to the other end of the clog body and tying the exposed opposite ends of the hemp core together on the under surface of the clog body to thereby complete the securing of the thong to the clog body. Therefore, the production of the prior art thong and securing the thong to the clog body require time consuming and tedious works. In addition, the thong itself, knots and/or connected portions of the thong are easily subjected to damage and/or breakage when moistened and/or handled roughly resuling in the separation of the thong from the clog body which means short service life of the clog thong.

SUMMARY OF THE INVENTION

Therefore, one principal object of the present invention is to provide a thong for a clog which can effectively eliminate the disadvantages of the prior art clog thongs referred to hereinabove.

Another object of the present invention is to provide a thong for a clog which can be produced and secured to the body of the clog in a quite simpler manner and at less expense.

Another object of the present invention is to provide a unitary thong for a clog which is formed of pliable synthetic resin and does not require a fore strap and tying of the thong which have been otherwise required.

Another object of the present invention is to provide a thong for a clog which is formed of pliable synthetic resin having an ecliptical cross-section which gives a comfortable touch to the instep of the clog wearer's foot.

A further object of the present invention is to provide a pliable synthetic resin clog thong which has resistance against moisture and/or rough handling to thereby enjoy a prolonged service life.

The above and other objects and attendant advantages of the present invention will be more readily apparent to those skilled in the art from a reading of the following detailed description in conjunction with the accompanying drawing which shows a preferred embodiment of the invention for illustration purpose only, but not for limiting the scope of the same in any way.

PREFERRED EMBODIMENT OF THE INVENTION

Figure 1:
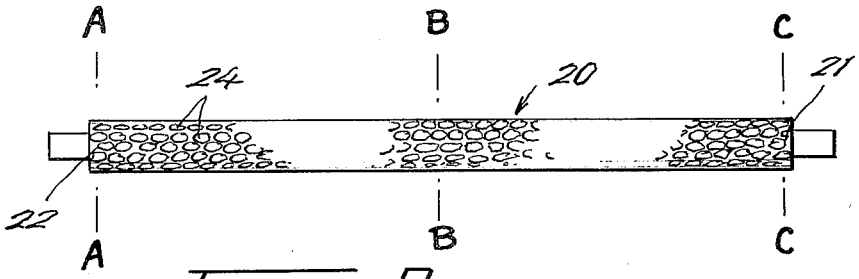
FIG. 1 is a plan view of one preferred embodiment of synthetic resin clog thong constructed in accordance with the present invention.

The present invention will be now described referring to the accompanying drawing in which the preferred embodiment of the invention is illustrated. Reference numeral 10 generally denotes the body of a clog which can be formed of any one of materials which have been conventionally employed in the production of clogs and has a conventional configuration. The clog body 10 is formed adjacent to one end with a first pair of elongated through holes 11 which extend in parallel to each other and also to the longitudinal axis of the clog body 10. The holes 11 are positioned on the opposite sides of the longitudinal axis of the clog body in close proximity to the axis. The clog body 10 is also provided adjacent to the other end with a second pair of elongated through holes 12 which are positioned adjacent to the opposite side edges thereof on the opposite sides of the longitudinal axis of the body. The second pair of holes 12 extend at an angle with respect to the longitudinal axis of the clog body and diverge from each other toward the other end of the clog body 10.

Figure 2:
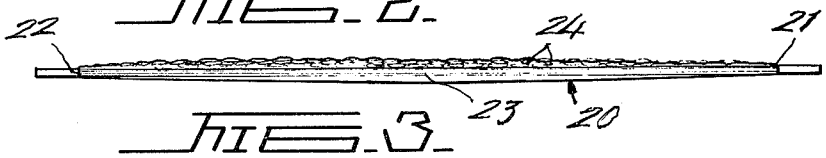
FIG. 2 is a side elevational view of said thong as shown in FIG. 1.
Figure 3:
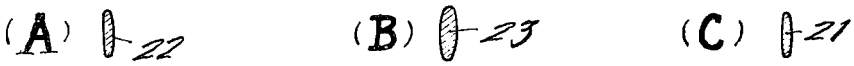
FIG. 3A is a cross-sectional view taken substantially along the line A — A of FIG. 1.
FIG. 3B is a cross-sectional view taken substantially along the line B — B of FIG. 1.
FIG. 3C is a cross-sectional view taken substantially along the line C — C of FIG. 1.
Figure 4:
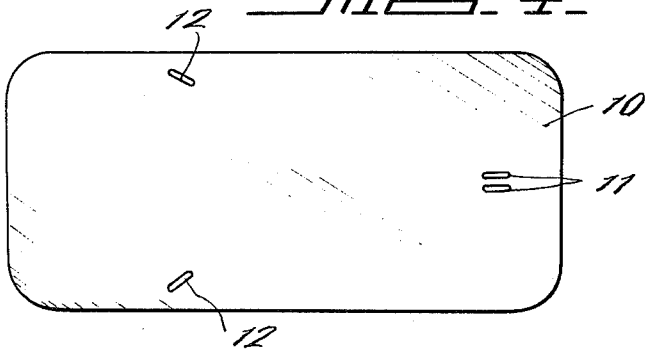
FIG. 4 is a plan view of the body of a clog with which said thong is employed.
Figure 5:
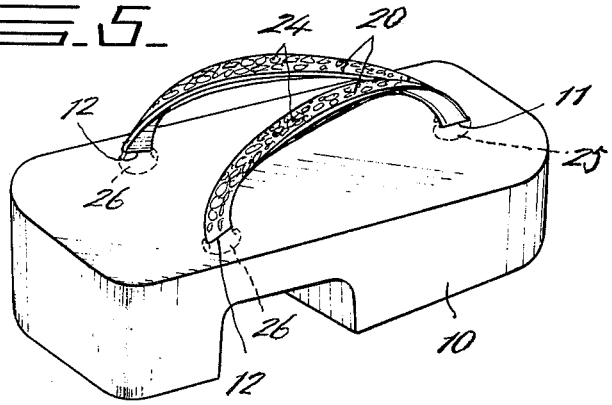
FIG. 5 is a perspective view of a complete clog.

Referring to FIGS. 1 through 3 of the accompanying drawing in which the preferred embodiment of clog thong 20 of the invention is illustrated. The thong 20 may be formed of any one of conventional pliable synthetic resins and has a substantially uniform width along a substantial portion thereof except for the opposite ends 21, 22 which are reduced in width. As more clearly seen in FIG. 2, the middle section 23 of the thong 20 has a substantially ecliptical configuration in cross-section and stream-lined configuration in side elevation having a maximum thickness in the center in the length of the middle section from where the thickness reduces smoothly toward the opposite ends 21, 22 of the thong 20 which have a substantially uniform thickness less than the minimum thickness end portions of section 23.

In assembling the above-mentioned components into a clog, the end 21 of the synthetic resin thong 20 is passed through one of the first pair of elongated holes 11 from the upper surface of the clog body 10 until the extreme end portion of the end 21 protrudes below the under surface of the clog body and similarly, the other end 22 of the thong 20 is passed through one of the second pair of holes 12 from the upper surface of the clog body until the extreme end portion of the end 22 protrudes below the under surface of the clog body. Following the same proceduce, the opposite ends of another thong which is quite identical with the thong 20 are passed through the respective others of the two pairs of holes 11, 11 and 12, 12. The protruding extreme end portions of the ends 21, 21 and 22, 22 of the two thongs 20 are fused together by applying heat thereto and allowed to cool to form lumps 25 and 26, respectively, which have bulks larger than the dimensions of the holes 11 and 12, respectively, so that the thongs can be prevented coming out of the holes 11, 11 and 12, 12 even if a pulling force is applied on the thongs 20.

Since the first pair of holes 11, 11 extend in parallel to each other and to the longitudinal axis of the clog body in close proximity to the latter and the adjacent ends of the middle sections 23 of the thongs 20 are substantially flat, the big or first and second toes of the wearer's foot can easily and smoothly engage the above-mentioned adjacent ends of the thong middle sections 23. In addition, the middle sections 23 of the thongs 20 smoothly arch upwardly of the upper surface of the clog body 10 substantially in conformity with the configuration of the instep of the wearer's foot and have a smoothly varying ecliptical cross-section and a stream-lined configuration as seen in side elevation, the middle sections 23 of the thongs 20 will not tightly fit on the instep of the wearer's foot, but will smoothly contact the instep of the wearer's foot. Especially, since the second pair of holes 12 are positioned at an angle with respect to the longitudinal axis of the thong body 10, the other ends of the middle sections 23 of the thongs positioned adjacent to the second pair of holes 12 twist to such a degree that the thong middle section ends can follow the configuration of the adjacent or contacting areas of the instep of the wearer's foot so as to contact the instep areas comfortably to thereby eliminate any score which will be otherwise caused by the clog thongs after a long walk of the wearer on clogs.

From the foregoing description on the preferred embodiment of the present invention, it will be appreciated that the invention provides a novel clog thong which can be produced in a simpler manner at less expense, can be easily secured to the clog body and enjoys an extended service life.

While only one embodiment of the invention has been shown and described in detail, it will be understood that the same is for illustration purpose only and not to be taken as a definition of the invention, reference being had for the purpose to the appended claim.

What is claimed is:

1. In a clog comprising a body provided adjacent to one end with a first pair of holes positioned on the opposite sides of the longitudinal axis of said body in proximity to the latter and adjacent to the other end with a second pair of holes positioned on the opposite sides of said longitudinal axis at an angle thereto in proximity to the opposite side edges of said body; and a pair of synthetic resin thongs with the opposite ends of each of said thongs passing through each one of said first and second pairs of holes, respectively, characterized by that each of said synthetic resin thongs has a wider middle section of substantially uniform width and the narrower opposite ends of uniform width passing through each one of said first and second pairs of holes, respectively and the adjacent ends of said pair of thongs passing through said first pair of holes are fused together on the under surface of said clog body to form a lump having a bluk larger than the dimensions of the associated holes while the ends of said pair of thongs passing through said second pair of holes are fused individually on the under surface of said clog body to form separate lumps larger than the associated holes, said pair of thongs each having a smoothly varying ecliptical configuration in cross-section and a stream-lined configuration in side elevation with the center of said middle section having a maximum thickness from where the thickness reduces smoothly toward the opposite ends of the associated thong.

* * * * *